US007604856B2

(12) United States Patent
Kronzer et al.

(10) Patent No.: US 7,604,856 B2
(45) **Date of Patent: *Oct. 20, 2009**

(54) HEAT TRANSFER PAPER WITH PEELABLE FILM AND DISCONTINUOUS COATINGS

(75) Inventors: Frank J. Kronzer, Woodstock, GA (US); Robert A. Janssen, Alpharetta, GA (US)

(73) Assignee: Neenah Paper, Inc., Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/755,427

(22) Filed: May 30, 2007

(65) Prior Publication Data

US 2007/0221317 A1 Sep. 27, 2007

Related U.S. Application Data

(63) Continuation of application No. 10/003,698, filed on Oct. 31, 2001, now Pat. No. 7,238,410.

(60) Provisional application No. 60/244,647, filed on Oct. 31, 2000, provisional application No. 60/244,852, filed on Nov. 1, 2000.

(51) Int. Cl.
*B41B 5/00* (2006.01)

(52) U.S. Cl. ..... 428/195.1; 428/317.3; 428/32.77; 428/323; 156/244.11; 156/244.16

(58) Field of Classification Search ..... 428/195.1, 428/317.3, 32.3, 32.77, 323; 156/244.11, 156/244.16; 503/201, 227
See application file for complete search history.

(56) References Cited

U.S. PATENT DOCUMENTS 1,858,673 A 5/1932 Lawrence
3,359,127 A 12/1967 Meyer et al.
3,616,176 A 10/1971 Jachimowicz
3,790,439 A 2/1974 LaPerre et al.
3,872,040 A 3/1975 Mollohan et al.
3,922,435 A 11/1975 Asnes
4,021,591 A 5/1977 DeVries et al.
4,107,365 A 8/1978 Reed et al.
4,167,414 A 9/1979 Morgan
4,224,358 A 9/1980 Hare
4,235,657 A 11/1980 Greenman
4,240,807 A 12/1980 Kronzer (Continued)

FOREIGN PATENT DOCUMENTS

DE 2842139 A1 4/1979

(Continued)

*Primary Examiner*—Bruce H. Hess
*Assistant Examiner*—Tamra L. Dicus
(74) *Attorney, Agent, or Firm*—Dority & Manning, P.A.

(57) ABSTRACT

The present invention is directed to a unique heat transfer material for use in transferring a discontinuous coating onto a substrate, such as an article of clothing. The heat transfer material of the present invention may be used cold peel transfer processes, resulting in an image-bearing coating having superior crack resistance, washability, and breathability compared to conventional image-bearing coatings. Additionally, the materials may be used on dark colored fabrics without washed-out appearance typically associated with printing on darker fabrics. The heat transfer material of the present invention produces superior results due to the use of discontinuous coatings.

15 Claims, 1 Drawing Sheet

U.S. PATENT DOCUMENTS

| | | | | |
|---|---|---|---|---|
| 4,303,717 | A | | 12/1981 | Andrews |
| 4,322,467 | A | | 3/1982 | Heimbach et al. |
| 4,351,871 | A | | 9/1982 | Lewis et al. |
| 4,383,878 | A | | 5/1983 | Young et al. |
| 4,399,209 | A | | 8/1983 | Sanders et al. |
| 4,496,618 | A | | 1/1985 | Pernicano |
| 4,517,237 | A | | 5/1985 | Pernicano |
| 4,536,434 | A | | 8/1985 | Magnotta |
| 4,548,857 | A | | 10/1985 | Galante |
| RE32,039 | E | | 11/1985 | Hollister et al. |
| 4,664,735 | A | | 5/1987 | Pernicano |
| 4,757,047 | A | | 7/1988 | Kosaka |
| 4,758,952 | A | | 7/1988 | Harris, Jr. et al. |
| 4,773,953 | A | | 9/1988 | Hare |
| 4,775,657 | A | | 10/1988 | Harrison et al. |
| 4,863,781 | A | * | 9/1989 | Kronzer ..... 428/200 |
| 4,929,501 | A | | 5/1990 | Okada et al. |
| 4,966,815 | A | | 10/1990 | Hare |
| 4,980,224 | A | | 12/1990 | Hare |
| 5,019,475 | A | | 5/1991 | Higashiyama et al. |
| 5,028,028 | A | | 7/1991 | Yamada et al. |
| 5,059,580 | A | | 10/1991 | Shibata et al. |
| 5,064,743 | A | | 11/1991 | Koshizuka et al. |
| 5,087,527 | A | | 2/1992 | Shimura et al. |
| 5,110,389 | A | | 5/1992 | Hiyoshi et al. |
| 5,132,277 | A | | 7/1992 | Kaszczuk et al. |
| 5,139,917 | A | | 8/1992 | Hare |
| 5,141,915 | A | | 8/1992 | Roenigk et al. |
| 5,147,489 | A | | 9/1992 | Scrutton et al. |
| 5,151,326 | A | | 9/1992 | Matsuda et al. |
| 5,236,801 | A | | 8/1993 | Hare |
| 5,242,739 | A | | 9/1993 | Kronzer et al. |
| 5,248,543 | A | | 9/1993 | Yamaguchi et al. |
| 5,252,531 | A | | 10/1993 | Yasuda et al. |
| 5,252,533 | A | | 10/1993 | Yasuda et al. |
| 5,263,781 | A | | 11/1993 | Mima et al. |
| 5,264,279 | A | | 11/1993 | Imamura et al. |
| 5,271,990 | A | | 12/1993 | Kronzer et al. |
| 5,286,521 | A | | 2/1994 | Matsuda et al. |
| 5,310,589 | A | | 5/1994 | Nagashima |
| 5,318,943 | A | | 6/1994 | Ueno et al. |
| 5,332,713 | A | | 7/1994 | Oldfield et al. |
| 5,334,439 | A | | 8/1994 | Kawaguchi et al. |
| 5,356,853 | A | | 10/1994 | Ueno et al. |
| 5,362,548 | A | * | 11/1994 | Hiyoshi et al. ..... 428/32.6 |
| 5,362,703 | A | | 11/1994 | Kawasaki et al. |
| 5,372,987 | A | | 12/1994 | Fisch et al. |
| 5,372,988 | A | | 12/1994 | Takeuchi et al. |
| 5,387,574 | A | | 2/1995 | Campbell et al. |
| 5,407,724 | A | | 4/1995 | Mimura et al. |
| 5,413,841 | A | | 5/1995 | Mahn, Sr. et al. |
| 5,419,944 | A | | 5/1995 | Sammis |
| 5,427,997 | A | | 6/1995 | Oshima et al. |
| 5,431,501 | A | | 7/1995 | Hale et al. |
| 5,432,258 | A | | 7/1995 | Yoshimura |
| 5,444,037 | A | | 8/1995 | Imai et al. |
| 5,468,532 | A | * | 11/1995 | Ho et al. ..... 428/40.9 |
| 5,484,644 | A | | 1/1996 | Imamura et al. |
| 5,508,105 | A | | 4/1996 | Orensteen et al. |
| 5,571,766 | A | | 11/1996 | Imai et al. |
| 5,614,345 | A | | 3/1997 | Gumbiowski et al. |
| 5,616,155 | A | | 4/1997 | Kronzer |
| 5,647,935 | A | | 7/1997 | Hoshino et al. |
| 5,654,080 | A | | 8/1997 | Hayashi et al. |
| 5,660,928 | A | | 8/1997 | Stokes et al. |
| 5,670,448 | A | | 9/1997 | Kometani |
| 5,707,925 | A | | 1/1998 | Akada et al. |
| 5,716,477 | A | | 2/1998 | Yamaguchi et al. |
| 5,716,900 | A | | 2/1998 | Kronzer et al. |
| 5,770,268 | A | | 6/1998 | Kuo et al. |
| 5,776,854 | A | | 7/1998 | Hayashi |
| 5,789,134 | A | | 8/1998 | Brault et al. |
| 5,798,161 | A | | 8/1998 | Kita et al. |
| 5,798,179 | A | | 8/1998 | Kronzer |
| 5,846,367 | A | | 12/1998 | Omote et al. |
| 5,861,355 | A | | 1/1999 | Olson et al. |
| 5,876,836 | A | | 3/1999 | Imamura et al. |
| 5,879,790 | A | * | 3/1999 | Sogabe et al. ..... 428/32.69 |
| 5,879,813 | A | | 3/1999 | Tanaka et al. |
| 5,880,065 | A | | 3/1999 | Hayashi et al. |
| 5,885,928 | A | | 3/1999 | Hirano et al. |
| 5,891,824 | A | | 4/1999 | Simpson et al. |
| 5,895,557 | A | | 4/1999 | Kronzer |
| 5,897,735 | A | | 4/1999 | Peskin |
| 5,898,018 | A | | 4/1999 | Hirano et al. |
| 5,925,712 | A | | 7/1999 | Kronzer |
| 5,942,335 | A | | 8/1999 | Chen et al. |
| 5,945,375 | A | | 8/1999 | Kronzer |
| 5,948,586 | A | | 9/1999 | Hare |
| 5,962,149 | A | | 10/1999 | Kronzer |
| 5,981,045 | A | | 11/1999 | Kuwabara et al. |
| 5,981,077 | A | | 11/1999 | Taniguchi |
| 6,004,419 | A | | 12/1999 | Torii |
| 6,017,636 | A | | 1/2000 | Tada et al. |
| 6,043,194 | A | | 3/2000 | Saito et al. |
| 6,054,223 | A | | 4/2000 | Tsuchiya et al. |
| 6,066,387 | A | | 5/2000 | Ueda et al. |
| 6,071,368 | A | | 6/2000 | Boyd et al. |
| 6,083,656 | A | | 7/2000 | Hare et al. |
| 6,083,872 | A | | 7/2000 | Adkins |
| 6,087,061 | A | | 7/2000 | Hare et al. |
| 6,096,475 | A | | 8/2000 | Hare et al. |
| 6,103,364 | A | | 8/2000 | Harris et al. |
| 6,113,725 | A | | 9/2000 | Kronzer |
| 6,114,021 | A | | 9/2000 | Pankratz et al. |
| 6,177,187 | B1 | | 1/2001 | Niemoller et al. |
| 6,180,219 | B1 | | 1/2001 | Hoshino et al. |
| 6,200,668 | B1 | | 3/2001 | Kronzer |
| 6,210,794 | B1 | | 4/2001 | Nakamura |
| 6,214,149 | B1 | | 4/2001 | Nakano et al. |
| 6,232,267 | B1 | | 5/2001 | Oshima et al. |
| 6,232,268 | B1 | | 5/2001 | Narita et al. |
| 6,245,710 | B1 | | 6/2001 | Hare et al. |
| 6,251,824 | B1 | | 6/2001 | Ueno et al. |
| 6,265,053 | B1 | | 7/2001 | Kronzer et al. |
| 6,281,166 | B1 | | 8/2001 | Kronzer |
| 6,290,798 | B1 | | 9/2001 | Onishi et al. |
| 6,291,062 | B1 | | 9/2001 | Oshima et al. |
| 6,294,307 | B1 | | 9/2001 | Hare et al. |
| 6,309,495 | B1 | | 10/2001 | Lakes |
| 6,316,385 | B1 | | 11/2001 | Usuki et al. |
| 6,335,307 | B1 | | 1/2002 | Imai et al. |
| 6,346,313 | B1 | | 2/2002 | Cook |
| 6,350,508 | B1 | | 2/2002 | Ueno et al. |
| 6,358,660 | B1 | | 3/2002 | Agler et al. |
| 6,383,710 | B2 | | 5/2002 | Hare et al. |
| 6,395,375 | B1 | | 5/2002 | Imamura et al. |
| 6,406,142 | B1 | | 6/2002 | Sato et al. |
| 6,410,200 | B1 | | 6/2002 | Williams et al. |
| 6,423,466 | B2 | | 7/2002 | Hare et al. |
| 6,428,878 | B1 | | 8/2002 | Kronzer |
| 6,432,549 | B1 | | 8/2002 | Kronzer |
| 6,450,633 | B1 | | 9/2002 | Kronzer |
| 6,465,393 | B1 | | 10/2002 | Nakano et al. |
| 6,482,285 | B2 | | 11/2002 | Cross |
| 6,497,781 | B1 | | 12/2002 | Dalvey et al. |
| 6,509,131 | B2 | | 1/2003 | Hare et al. |
| 6,531,216 | B1 | | 3/2003 | Williams et al. |
| 6,551,692 | B1 | | 4/2003 | Dalvey et al. |
| 6,562,740 | B1 | | 5/2003 | Todt |
| 6,582,803 | B2 | | 6/2003 | Cole et al. |
| 6,593,406 | B2 | | 7/2003 | Sargeant et al. |
| 6,613,412 | B1 | | 9/2003 | Dressler |
| 6,703,086 | B2 | | 3/2004 | Kronzer et al. |

| | | | |
|---|---|---|---|
| 6,737,152 | B2 | 5/2004 | Suzuki et al. |
| 6,916,751 | B1 * | 7/2005 | Kronzer ..... 442/327 |
| 2002/0146544 | A1 | 10/2002 | Kronzer |
| 2002/0153110 | A1 | 10/2002 | Yamaguchi et al. |
| 2003/0008116 | A1 | 1/2003 | Williams et al. |
| 2005/0142307 | A1 | 6/2005 | Kronzer |
| 2005/0145325 | A1 | 7/2005 | Kronzer |
| 2006/0019043 | A1 | 1/2006 | Kronzer |
| 2006/0283540 | A1 | 12/2006 | Kronzer |

FOREIGN PATENT DOCUMENTS

| | | | |
|---|---|---|---|
| EP | 0241212 | A2 | 10/1987 |
| EP | 0241212 | A3 | 10/1987 |
| EP | 0266094 | A1 | 5/1988 |
| EP | 0466503 | A1 | 1/1992 |
| EP | 0652114 | B1 | 5/1995 |
| EP | 0842786 | A1 | 5/1998 |
| EP | 0850786 | B1 | 7/1998 |
| EP | 1020299 | B1 | 7/2000 |
| EP | 1219460 | A2 | 7/2002 |
| EP | 1316435 | A1 | 6/2003 |
| EP | 1340626 | A1 | 9/2003 |
| EP | 1344653 | A1 | 9/2003 |
| EP | 0933226 | B1 | 3/2004 |
| FR | 2442721 | | 6/1980 |
| GB | 1487599 | | 10/1977 |
| GB | 2084931 | A | 4/1982 |
| GB | 2147614 | A | 5/1985 |
| GB | 2243332 | A | 10/1991 |
| JP | 1208192 | | 8/1989 |
| JP | 3010879 | | 1/1991 |
| JP | 6155995 | | 6/1994 |
| JP | 6312573 | | 11/1994 |
| JP | 200377652 | | 10/2003 |
| WO | WO 8704393 | A1 | 7/1987 |
| WO | WO 9000473 | A1 | 1/1990 |
| WO | WO 9106433 | A1 | 5/1991 |
| WO | WO 9114207 | A1 | 9/1991 |
| WO | WO 9222857 | A1 | 12/1992 |
| WO | WO 9321561 | A1 | 10/1993 |
| WO | WO 9508419 | A1 | 3/1995 |
| WO | WO 9610491 | A1 | 4/1996 |
| WO | WO 9701448 | A1 | 1/1997 |
| WO | WO 9733763 | A2 | 9/1997 |
| WO | WO 9733763 | A3 | 9/1997 |
| WO | WO 9925917 | A1 | 5/1999 |
| WO | WO 0059733 | A1 | 10/2000 |
| WO | WO 0064685 | A1 | 11/2000 |
| WO | WO 0073570 | A1 | 12/2000 |
| WO | WO 0103941 | A1 | 1/2001 |
| WO | WO 0112448 | A1 | 2/2001 |
| WO | WO 0117792 | A1 | 3/2001 |
| WO | WO 0123664 | A1 | 4/2001 |
| WO | WO 0162514 | A2 | 8/2001 |
| WO | WO 0162514 | A3 | 8/2001 |
| WO | WO 0236353 | A2 | 5/2002 |
| WO | WO 0236353 | A3 | 5/2002 |
| WO | WO 02055311 | A2 | 7/2002 |
| WO | WO 02055311 | A3 | 7/2002 |
| WO | WO 03006736 | A1 | 1/2003 |
| WO | WO 03066337 | A2 | 8/2003 |
| WO | WO 03066337 | A3 | 8/2003 |

* cited by examiner

HEAT TRANSFER PAPER WITH PEELABLE FILM AND DISCONTINUOUS COATINGS

CROSS REFERENCE TO RELATED APPLICATIONS

The present application is a continuation application of U.S. patent application Ser. No. 10/003,698, filed on Oct. 31, 2001 now U.S. Pat. No. 7,238,410, which claims priority to U.S. Provisional Patent Application Ser. No. 60/244,647, filed on Oct. 31, 2000 and U.S. Provisional Patent Application Ser. No. 60/244,852, filed on Nov. 1, 2000.

TECHNICAL FIELD

The present invention is directed to heat transfer materials, methods of making heat transfer materials, and methods of transfer coating using heat transfer materials.

BACKGROUND OF THE INVENTION

In recent years, a significant industry has developed which involves the application of customer-selected designs, messages, illustrations, and the like (referred to collectively hereinafter as "customer-selected graphics") on articles of clothing, such as T-shirts, sweat shirts, and the like. These customer-selected graphics typically are commercially available products tailored for a specific end-use and are printed on a release or transfer paper. The graphics are transferred to the article of clothing by means of heat and pressure, after which the release or transfer paper is removed.

Heat transfer papers having an enhanced receptivity for images made by wax-based crayons, thermal printer ribbons, ink-jet printers, impact ribbon or dot-matrix printers, are well known in the art. Typically, a heat transfer material comprises a cellulosic base sheet and an image-receptive coating on a surface of the base sheet. The image-receptive coating usually contains one or more film-forming polymeric binders, as well as, other additives to improve the transferability and printability of the coating. Other heat transfer materials comprise a cellulosic base sheet and an image-receptive coating, wherein the image-receptive coating is formed by melt extrusion or by laminating a film to the base sheet. The surface of the coating or film may then be roughened by, for example, passing the coated base sheet through an embossing roll.

Much effort has been directed at generally improving the transferability of an image-bearing laminate (coating) to a substrate. For example, an improved cold-peelable heat transfer material has been described in U.S. Pat. No. 5,798,179, which allows removal of the base sheet immediately after transfer of the image-bearing laminate ("hot peelable heat transfer material") or some time thereafter when the laminate has cooled ("cold peelable heat transfer material"). Moreover, additional effort has been directed to improving the crack resistance and washability of the transferred laminate. The transferred laminate must be able to withstand multiple wash cycles and normal "wear and tear" without cracking or fading.

Various techniques have been used in an attempt to improve the overall quality of the transferred laminate and the article of clothing containing the same. For example, plasticizers and coating additives have been added to coatings of heat transfer materials to improve the crack resistance and washability of image-bearing laminates on articles of clothing. However, cracking and fading of the transferred image-bearing coating continues to be a problem in the art of heat transfer coatings.

One of the problems with conventional heat transfer materials occurs when attempting to transfer materials to a dark substrate. When transferring material to a dark substrate, an opaque light colored or white background is often required. When conventional heat transfer materials and processes are used, opacity and whiteness are lost. The images have a washed out appearance of the layer they are printed on, since the image penetrates into either the opaque layer or the fabric. Another problem with conventional heat transfer materials occurs with cracking of the image after transfer of the image. This cracking results after normal washing of the substrate and printed image due to normal stretching of the fabric as the image layer is a continuous film on the surface of a bendable, stretchable fabric.

What is needed in the art is a heat transfer material, which can be transferred to dark material while maintaining brightness and minimal fading even after extensive washing. If a white or light colored opaque coating is used in the heat transfer material, the opaque coating should be maintained after extensive washing. Also, what is needed is a heat transfer material that can be transferred to a material while not cracking and breaking apart even after extensive washing. Finally, what is needed is a heat transfer material that has increased breathability and drapability such that the material is more comfortable and softer to wear.

SUMMARY OF THE INVENTION

The present invention is a heat transfer material and process having a peelable film layer designed to melt and penetrate. Under this is a release coated substrate. This release coated substrate is desirably paper. The peelable film is coated with one or more discontinuous layers, the compositions of which can be tailored to fit multiple uses. In one embodiment of the present invention, the discontinuous coating is an opaque discontinuous coating that includes a white pigment to provide opacity and whiteness. Designs can be created with this by cutting shapes or letters out of the heat transfer material, removing the cut out shapes or letters, peeling away the release coated substrate from the peelable film layer, applying the shapes or letters face up onto a fabric such that the peelable film is contacting the fabric and the opaque layer is exposed, then applying heat to them. A release paper is used between the opaque discontinuous layer and the source of heat. The heat source may be selected from different means such as an iron or a heat press. The discontinuous coating provides a means of preserving the fabrics porosity and stretchability without introducing unattractive, random cracks in the film. The peelable film melts and penetrates into the fabric and bonds the image permanently.

The present invention may also include a discontinuous, printable layer that is placed on top of the discontinuous, opaque layer. The discontinuous, printable layer permits words or images to be printed on the transfer material, such as with an ink jet printer. Then, in the same manner as described, the shapes or letters may be cut from the heat transfer material, peeled from the release coated substrate, placed on a fabric and subjected to a heat source to transfer the discontinuous, printable layer and the discontinuous, opaque layer onto the surface of the fabric while the peelable film layer melts and penetrates into the fabric to form a permanent bond.

Additionally, the present invention may include a heat transfer material that includes a peelable film transfer layer as the top surface. Under this is a release coated substrate. Then, instead of using a discontinuous, opaque layer, a discontinuous, printable layer is placed on the peelable film transfer layer. Similar to the previous embodiment, an image may be printed on the discontinuous, printable layer. Then, as previously described, designs can be created with this material by printing an image on the printable layer, cutting out the image from the heat transfer material, removing the release coated substrate, applying the cut-out image face up onto a fabric such that the peelable film is contacting the fabric and the printable layer is exposed, then applying heat to them. A release paper is used between the discontinuous, printable layer and the source of heat. However, since this type of material does not include the discontinuous, opaque layer, this material is best used with white or light colored fabrics.

Finally, the discontinuous coatings of the present invention may include crosslinking agents. The crosslinking agents hold the coating or coatings on the surface of the fabric while the peelable film melts and penetrates into the fabric and bonds the image permanently. Crosslinking agents may be included in either the printable coatings, the opaque coatings, or both.

The present invention is also directed to a method of making a printable heat transfer material having the above described structures.

The present invention is further directed to a method of transfer coating using the above described printable heat transfer materials. The method includes the steps of applying heat and pressure to the heat transfer material.

These and other features and advantages of the present invention will become apparent after a review of the following detailed description of the disclosed embodiments and the appended claims.

DETAILED DESCRIPTION OF THE INVENTION

The present invention is directed to a unique heat transfer material for use in transferring an image-bearing coating onto a substrate, such as an article of clothing. The heat transfer material of the present invention may be used in a cold peel transfer process, resulting in an image-bearing coating having superior crack resistance, washability, drapability and breathability compared to conventional image-bearing coatings. Additionally, the materials may be used on dark colored fabrics without washed-out appearance typically associated with printing on darker fabrics. The heat transfer material of the present invention produces superior results due to the use of discontinuous coatings.

Figure 1:
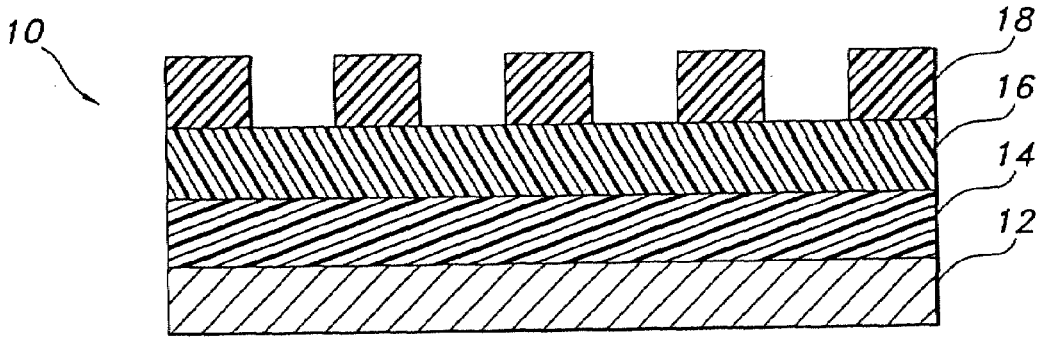
FIG. 1 is a cross-sectional view of a heat transfer material according to one embodiment of the present invention.

As shown in FIG. 1, the present invention includes a heat transfer material 10 and process wherein a peelable film transfer layer 16 is used to melt and penetrate into a fabric or other bendable material. Under this is a release coating 14 and substrate 12. This substrate 12 is desirably paper. The peelable film 16 is coated with one or more discontinuous layers 18, the compositions of which can be tailored to fit multiple uses. In one embodiment of the present invention, the discontinuous coating includes a white pigment to provide opacity and whiteness. Designs can be created with this by cutting shapes or letters out of the heat transfer material 10, removing the cut out shapes or letters, peeling away the release coating 14 and substrate 12 from the peelable film layer 16, applying the shapes or letters face up onto a fabric such that the peelable film 16 is contacting the fabric and the opaque layer is exposed, then applying heat to them. A release paper (not shown) is used between the film 16 and the source of heat. The heat source may be selected from different means such as an iron or a heat press. The discontinuous coating provides a means of preserving the fabric's porosity and stretchability without introducing unattractive, random cracks in the film. Additionally, the fabric is more breathable as a result of the discontinuities in the heat transfer material 10.

Figure 2:
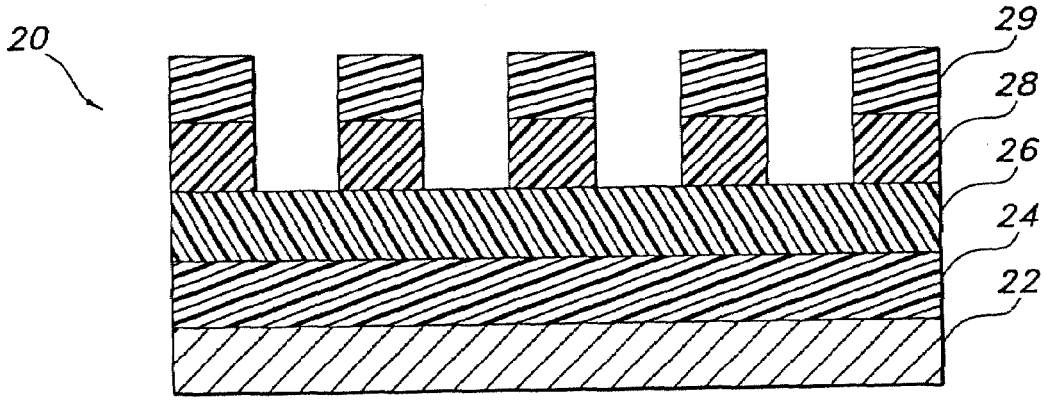
FIG. 2 is a cross-sectional view of a heat transfer material according to a second embodiment of the present invention.

In a second embodiment, as shown in FIG. 2, the heat transfer material 20 of present invention employs the same type of paper 22, release coat 24, film 26 and the discontinuous, opaque layer 28. It has an additional, discontinuous, printable layer 29 on top of the discontinuous, opaque layer 28. This layer 29 may be tailored to use with various printers, especially ink jet printers. It is used in the same manner as the first, except that images can first be printed on it. The discontinuous, opaque layer 28 and discontinuous printable layer 29 remain exposed and opposite the surface of the fabric when the peelable film 26 bearing the image is contacted with the fabric. Then, with heat and pressure, the peelable film 26 melts and penetrates into the fabric. Desirably, a release paper (not shown) is used to avoid sticking to the printable layer to the heat source. The peelable film layer 26 melts and penetrates into the fabric-forming a permanent bond. The release paper may be any release paper, such as a silicone-coated paper available from Brownbridge.

Figure 3:
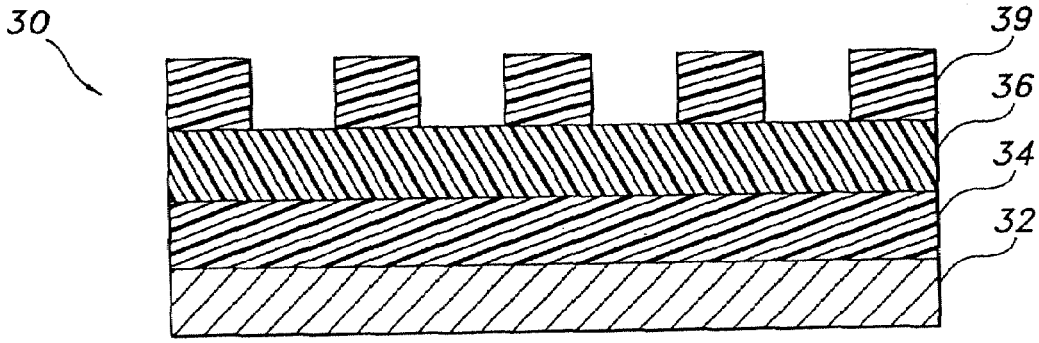
FIG. 3 is a cross-sectional view of a heat transfer material according to a third embodiment of the present invention.

A third embodiment, as shown in FIG. 3, of a heat transfer material 30 of the present invention, desirably for use with white or light colored fabrics, employs the same paper 32, release coating 34 and peelable film 36. It has no discontinuous opaque layer. Instead, the discontinuous, printable layer 39 is on top of the peelable film 36. An image may be printed onto the discontinuous, printable layer 39. The image and the discontinuous, printable layer 39 remain on the surface when the peelable film 36 bearing the image is peeled from the release coating 34 and paper 32 and heated image side up onto a fabric using release paper between the discontinuous, printable layer 39 and the heat source.

A fourth embodiment employs crosslinking agents in the discontinuous, opaque layer and/or the discontinuous, printable layers. The crosslinking agents hold the coating or coatings on the surface of the fabric while the peelable film penetrates into the fabric and bonds the image permanently.

The present invention, therefore, provides a heat transfer material having a substrate, a release coating, a peelable film, and one or more discontinuous layers. The discontinuous layers are selected from a discontinuous opaque layer, a discontinuous, printable layer, a discontinuous opaque layer having crosslinking agents, a discontinuous, printable layer having crosslinking agents or a combination of these layers.

The interior peelable layer of the heat transfer material of the present invention may comprise any material capable of melting and conforming to the surface of a substrate to be coated. In order to melt and bond sufficiently, the interior peelable layer desirably has a melt flow index of less than about 800 as determined using ASTM D1238-82. Desirably, the peelable layer also has a melting temperature and/or a softening temperature of less than about 400° F. As used herein, "melting temperature" and "softening temperature" are used to refer to the temperature at which the peelable layer melts and/or flows under conditions of shear. More desirably, the peelable layer has a melt flow index of from about 0.5 to about 800, and a softening temperature of from about 150° F. to about 300° F. Even more desirably, the peelable layer has a melt flow index of from about 2 to about 600, and a softening temperature of from about 200° F. to about 250° F.

The peelable layer may comprise one or more thermoplastic polymers including, but not limited to, polyolefins; polyethylene, ethylene-containing copolymers, or mixtures thereof. In addition to the thermoplastic polymer(s), other materials may be added to the peelable layer to provide improved melt flow properties, such as plasticizers in solid or liquid form.

In a desirable embodiment of the present invention, the peelable layer may be in the form of a melt-extruded film. The extruded film may comprise one or more of the above-described materials having the desired meltability and conformability properties.

The peelable layer of the heat transfer material of the present invention may have a layer thickness, which varies considerably depending upon a number of factors including, but not limited to, the substrate to be coated, the press temperature, and the press time. Desirably, the peelable layer has a thickness of less than about 5 mil. (0.13 mm). More desirably, the peelable layer has a thickness of from about 0.5 mil. to about 4.0 mil. Even more desirably, the peelable layer has a thickness of from about 1.0 mil. to about 2.0 mil.

In addition to the peelable layer, the heat transfer material of the present invention comprises a release coating layer. The release coating layer separates the transferable material of the heat transfer material from the non-transferable material of the heat transfer material. The release coating layer does not transfer to a coated substrate. Consequently, the release coating layer may comprise any material having release characteristics. The release coating layer is adjacent to a surface of the peelable layer.

A number of release coating layers are known to those of ordinary skill in the art, any of which may be used in the present invention. Suitable polymers include, but are not limited to, silicone-containing polymers, acrylic polymers, poly (vinyl acetate), or mixtures thereof. Further, other materials having a low surface energy, such as polysiloxanes and fluorocarbon polymers, may be used in the release coating layer. Desirably, the release coating layer comprises a cross-linked silicone-containing polymer or a cross-linked acrylic polymer. Suitable silicone-containing polymers include, but are not limited to, SYL-OFF® 7362, a silicone-containing polymer available from Dow Corning Corporation (Midland, Mich.). Suitable acrylic polymers include, but are not limited to, HYCAR® 26672, an acrylic latex available from B.F. Goodrich, Cleveland, Ohio; HYCAR® 26684, an acrylic latex also available from B.F. Goodrich, Cleveland, Ohio; and Rhoplex SP 100, an acrylic latex from Rohm and Haas, Wilmington, Del.

The release coating layer may further contain additives including, but not limited to, a cross-linking agent, a release-modifying additive, a surfactant, a viscosity-modifying agent, or mixtures thereof. Suitable cross-linking agents include, but are not limited to, XAMA7, an aziridine cross-linker available from Sybron Chemical, Birmingham, N.J. Suitable release-modifying additives include, but are not limited to, SYL-OFF® 7210, a release modifier available from Dow Corning Corporation. Suitable curing agents include, but are not limited to, SYL-OFF® 7367, a curing agent available from Dow Corning Corporation. Suitable surfactants include, but are not limited to, TERGITOL® 15-S40, available from Union Carbide; TRITON® X100, available from Union Carbide; and Silicone Surfactant 190, available from Dow Corning Corporation. In addition to acting as a surfactant, Silicone Surfactant 190 also functions as a release modifier, providing improved release characteristics, particularly in cold peel applications.

The release coating layer may have a layer thickness, which varies considerably depending upon a number of factors including, but not limited to, the substrate to be coated, and the film to be temporarily bonded to it. Typically, the release coating layer has a thickness of less than about 2 mil. (52 microns). More desirably, the release coating layer has a thickness of from about 0.1 mil. to about 1.0 mil. Even more desirably, the release coating layer has a thickness of from about 0.2 mil. to about 0.8 mil.

The thickness of the release coating layer may also be described in terms of a basis weight. Desirably, the release coating layer has a basis weight of less than about 12 lb./144 $yd^2$ (45 gsm). More desirably, the release coating layer has a basis weight of from about 6.0 lb./144 $yd^2$ (22.5 gsm) to about 0.6 lb./144 $yd^2$ (2.2 gsm). Even more desirably, the release coating layer has a basis weight of from about 4.0 lb./144 $yd^2$ (15 gsm) to about 1.0 lb./144 $yd^2$ (3.8 gsm).

In addition to the layers described above, the heat transfer material comprises a base substrate. The exact composition, thickness or weight of the base is not critical to the transfer process since the base substrate is removed before the image is applied to the fabric. Thus, it may be adapted for various printing processes included in the above discussion. Some examples of possible base substrates include cellulosic non-woven webs and polymeric films. Generally, a paper backing of about 4 mils thickness is suitable for most applications. For example, the paper may be the type used in familiar office printers or copiers, such as Kimberly Clark's Neenah Paper's Avon White Classic Crest, 24 lb per 1300 sq ft. A number of different types of paper are suitable for the present invention including, but not limited to, common litho label paper, bond paper, and latex saturated papers.

The present invention also may include a discontinuous opaque coating. This coating includes a polymeric binder and an opacifying material. The opacifier is a particulate material which scatters light at it's interfaces so that the coating layer therefore is relatively opaque. Preferably, the opacifier is white and has a particle size and density well suited for light scattering. Such opacifiers are well known to those skilled in the graphic arts, and include particles of minerals such as aluminum oxide and titanium dioxide or of polymers such as polystyrene. The amount of opacifier needed in each case will depend on the desired opacity, the efficiency of the opacifier, and the thickness of the coating. For example, titanium dioxide at a level of approximately 20% in a film of one mil thickness provides adequate opacity for decoration of black fabric materials. Titanium dioxide is a very efficient opacifier and other types generally require a higher loading to achieve the same results.

In order to provide the opacity needed for fabric decoration, the coating must remain substantially on the surface of the fabric. If, in the transfer process, the heat and pressure cause the coating to become substantially imbedded into the fabric, the dark color of the fabric shows through, giving the transferred art a gray or chalky appearance. The coating should therefore resist softening to the point of becoming fluid at the desired transfer temperature. Recalling that the peelable film which supports the opaque coating must melt and flow into the fabric at the transfer temperature, the relationship needed between the peelable film and the opaque coating becomes clear. The opaque coating must not become fluid at or below the softening point of the peelable film. The terms "fluid" and "softening point" are used here in a practical sense. By fluid, it is meant that the coating would flow into the fabric easily. The term 'softening point' can be defined in several ways, such as a ring and ball softening point. The ring and ball softening point determination is done according to ASTM E28. A melt flow index is useful for describing the flow characteristics of peelable polymers. For example, a melt flow index of from 0.5 to about 800 under ASTM method D 1238-82 is specified for the peelable film layer of the present invention. For the opaque layer, the melt flow index should be less than that of the peelable film layer by a factor of at least ten, preferably by a factor of 100, and most preferably by a factor of at least 1000. Many types of extrudable polymers could be used in the opaque coating, the choice depending primarily on other requirements one may have in the decorated fabric. For example, polyurethanes can provide excellent water resistance, durability and flexibility. Polyolefins such as polypropylene and polyethylene are more economical but not as durable and do not recover as well when stretched, but would serve for many purposes. Other useful polymer types include polyesters, some of which have properties similar to polyurethanes and some of which are very stiff. Still others include polyamides such as nylon 6 and nylon 12. Still other useful polymers include copolymers such as ethylenevinylacetate and ethylenemethacrylic acid ionomers.

The opaque coating is desirably applied as a dispersion or solution of polymer in water or solvent, along with the dispersed opacifier. Many of the polymer types mentioned above are available as solutions in a solvent or as dispersions in water. For example, acrylic polymers and polyurethanes are available in many varieties in solvents or in water based latex forms. Other useful water based types include ethylenevinylacetate copolymer lattices, ionomer dispersions of ethylenemethacrylic acid copolymers and ethyleneacrylic acid copolymer dispersions. In many cases, washability and excellent water resistance of the decorated fabrics will be required. Polymer preparations which contain no surfactant, such as polyurethanes in solvents or amine dispersed polymers in water, such as polyurethanes and ethyleneacrylic acid dispersions can meet these requirements.

The heat transfer material may also include a discontinuous printable layer that may be printed with an image. As previously discussed, prior art images had a tendency to crack and become unsightly when stretched or washed. In addition, the image-bearing coatings were continuous films which gave the fabric a rubbery feel, while also making the fabric uncomfortable due to lack of breathability. The present invention provides a layer on the peelable film that contains the image, but is not a continuous coating. As such, this discontinuous layer will not split or crack when the fabric is stretched or worn, thereby maintaining the integrity of the image and a more cloth-like feel.

The discontinuous, printable layer may be adapted to suit various printing methods, including ink jet printing. For ink jet printing, the coating may be very similar to those described in U.S. Pat. Nos. 5,798,179, 5,501,902 and 6,033,739, which are hereby incorporated by reference. These coatings contain thermoplastic particles, binders and cationic resins as well as ink viscosity modifiers and are useful in conventional ink jet printing applications for fabric transfer. In the present invention, a crosslinking agent is added to such coatings so they will be held on the surface when a transfer is conducted. However, since the crosslinking agents inhibit the ability of the polymer to bond to the fabric under heat and pressure, the addition of a non-crosslinked peelable film is required. For use with other imaging methods, the requirements are slightly different. For electrostatic printing, an acrylic or polyurethane binder and a crosslinking agent would be sufficient since this printing method does not require powdered polymers for ink absorbency, cationic polymers or ink viscosity modifiers. Instead, slip agents and anti-static agents can be added to the crosslinkable coating to provide reliable sheet feeding into the printers. For thermal printings or crayon marking coatings, such as those described in U.S. Pat. No. 5,342,739, these coatings may be modified by addition of a crosslinking agent. For this method, the coating should be compatible with the thermal ribbon wax or resin based inks and must be smooth and uniform for good ribbon contact and uniform heat application.

As has been indicated, the discontinuous layer may be an opaque layer or a printable layer. The discontinuous white opaque layer is especially useful for dark fabrics as the discontinuous opaque coating provides contrast.

A printable layer allows an image to be printed onto the substrate, such as with an ink jet printer, and then transferred to the substrate. Discontinuous printable layers can be used with darker colored fabrics or on lighter colored fabrics. However, when used on darker fabrics, the discontinuous printable layer is applied over the discontinuous opaque layer. The opaque layer provides a white surface background for the colored graphics.

In another aspect of this invention, the opaque coating is crosslinked. Crosslinking gives a three dimensional polymer structure which does not flow under heat and pressure. Crosslinking also provides superior durability and resistance to water. Crosslinking is generally not possible in melt extruded coatings. Water and solvent based coatings can readily be crosslinked after drying the coating, usually by the action of heat on a multifunctional crosslinking agent. Crosslinking agents available for this purpose include multifunctional isocyanates, epoxy resins, aziridines, oxazolines, melamine-formaldehyde resins, and others. Generally, the amount of crosslinking agent needed is small relative to the amount of polymer, for example, 10% or less. The amount of heat needed to complete the crosslinking reaction varies with the type of crosslinking agent and the amount, and is generally available from the suppliers of the crosslinking agents. For example, polyfunctional aziridines require very little heat. The crosslinking can be completed in about one minute at 100 degrees C. or in one day at room temperature. Isocyanates also cure very rapidly but are usually not used in water as they react with water. Epoxy resins can also be formulated to react rapidly by a suitable choice of a catalytic amine curing agent.

Additionally, the present invention may use a second discontinuous crosslinked polymer layer, either alone or in conjunction with the discontinuous crosslinked opaque layer. The second discontinuous crosslinked polymer layer is a discontinuous crosslinked printable layer. The discontinuous crosslinked printable layer permits images to be printed on the polymer layer, such as with an ink jet printer. When the printed film is peeled from the substrate and then applied to a fabric, the crosslinkable polymer layer, which is a 3-dimensional polymer network, does not melt or flow appreciably into the fabric. The image thereby remains bright and sharp and not faded or washed-out looking. When used alone, the discontinuous crosslinked printable polymer layer works best on white or light-colored fabrics. However, the discontinuous crosslinked, printable layer may be used with a discontinuous crosslinked opaque layer to provide the advantages of being able to print the image, such as with an ink jet printer, while also providing the advantages of use on dark fabrics offered with the discontinuous crosslinked opaque layer.

The discontinuous crosslinked, printable layer that can be used in the present invention uses crosslinking agents that include, but are not limited to, polyfunctional aziridine crosslinking agents sold under the trademark XAMA 7

(Sybron Chemical Co., Birmingham, N.J.), multifunctional isocyanates, epoxy resins, oxazolines, and melamine-formaldehyde resins.

The image-bearing coating of the heat transfer material, comprising one or more of the above-described coating layers, may be transferred to an article of clothing, or other flexible surface, by removing the film from the backing, placing it image side up on a fabric, applying a release paper and applying heat and pressure.

In the present invention, the peelable layer because of the discontinuous nature, also conforms to the surface of the fabric, or other substrate, which may have an irregular (not flat) surface. This allows the penetration of the discontinuous opaque layer and/or the discontinuous printable layer into low areas of the material. The discontinuities provide breaks in the bridges between adjacent yarns so the fabric feel and stretch are much improved over conventional transfer-coated fabrics.

The present invention is also directed to a method of making a printable heat transfer material. The method comprises taking a substrate layer, applying a release coating layer onto the substrate layer, applying a peelable film coating onto the release coating layer, and then applying a discontinuous layer of polymer. The discontinuous layer may be selected from an opaque polymer layer, a printable layer, a crosslinkable opaque layer, a crosslinkable printable layer, or a combination of these layers. In one embodiment of the present invention, one or more of the above-described coating compositions are applied to the substrate layer by known coating techniques, such as by solution, roll, blade, and air-knife coating procedures. Each individual coating may be subsequently dried by any drying means known to those of ordinary skill in the art. Suitable drying means include, but are not limited to, steam-heated drums, air impingement, radiant heating, or a combination thereof. In an alternative embodiment, one or more of the above-described layers may be extrusion coated onto the surface of the substrate layer or a coating thereon. Any extrusion coating techniques, well known to those of ordinary skill in the art, may be used in the present invention.

If desired, any of the foregoing coating layers may contain other materials, such as processing aids, release agents, pigments, deglossing agents, antifoam agents, and the like. The use of these and similar materials is well known to those having ordinary skill in the art.

In order to produce the discontinuous coatings of the present invention, some special means of applying the coatings may be employed. For example, water or solvent based coatings can be printed onto the peelable film layer with flexographic or rotogravure printing presses. Water and solvent based printing with the types of coatings mentioned above is well established.

If the opaque coating layer is to be melt extruded, a means of applying the patterned coatings such as extruding strips or fibers could be applied, or the coating could be applied in patterns using melt spraying equipment.

In a preferred embodiment of the present invention, the opaque coating becomes discontinuous due to ridges which are impressed into the peelable film layer. The water based, opaque coating fills the areas between the ridges when it is applied. The ridges become the discontinuities in the opaque coating. This is described in detail in the examples below.

The present invention is further described by the examples which follow. Such examples, however, are not to be construed as limiting in any way either the spirit or scope of the present invention. In the examples, all parts are parts by weight unless stated otherwise.

EXAMPLE 1

Discontinuous coatings were prepared through use of a peelable film layer having ridges. The opaque, crosslinkable white coating and the printable, crosslinkable coating layers, after application to the ridged film, were interrupted by ridges of the peelable film which break the continuity of the coatings. The ridged film was prepared using a paper backing with a release coat and peelable film over the release coat. The paper backing was Kimberly Clark Neenah Paper 24 lb Avon white classic crest (24 lb. per 1300 sq. ft.). The release coating included 100 dry parts of Rhoplex SP100 (Rohm and Haas, Philadelphia, Pa.) and 60 parts ultrawhite 90 clay (Englehard, Iselin, N.J.). The coating weight was 2.7 lb. per 1300 sq. ft. The peelable film was Nucrel 599, a 500 melt index ethylene-methacrylic acid co-polymer from Dupont (Wilmington, Del.). The peelable film was 1.8 mils thick.

Ridges were impressed into the peelable film using a steel plate having grooves engraved into it at a temperature of 350° F. The grooves, in one direction only, were 4 mils wide and 2 mils deep. Spacing between the grooves was 40 mils. The plate material was spring steel, 23 mils thick. A release coating was applied to the grooved plate to prevent sticking of the peelable film. The release coating included 100 dry parts of Rhoplex SP100, 2 dry parts of silicone surfactant 190 (Dow Corning, Midland, Mich.), 5 dry parts of XAMA 7 multifunctional aziridine cross linker from Sybron Chemical, Birmingham, N.J., 0.1 dry parts of Q2-5211 silicone surfactant from Dow Coming and 10 dry parts of Carbowax 8000, a polyethylene glycol from Union Carbide, Danbury, Conn. The coating total solids content was approximately 25%. The coating weight was 2.5 lb per 1300 sq. ft. The pH of the coating was adjusted to between 9 and 10 with ammonia.

The release coating was applied first to an extrusion coated paper, then transferred to the metal plate with heat and pressure. The paper used for the transfer was Avon white classic crest with Nucrel 599 extrusion coating and the release coating. The transfer was done using a T-shirt press, 350° F. for 30 seconds. The release coating remained on the metal plate after cooling and removing the paper. Once applied, it provided release of the peelable films from the metal plate when subsequent samples of the ridged films were prepared.

The ridged films on the release coated substrate were prepared simply by pressing the peelable film and release coated substrate against the grooved plate for 30 seconds at 350° F. in a T-shirt press, cooling and removing.

When opaque or printable coatings were applied to the ridged film, little or no coating remained on the ridges after drying. After drying, the film was printed where applicable, removed from the backing, then transferred face up onto a fabric. A T-shirt press was used, 350° F. for 30 seconds. Between the heated press platen and the film, a release paper was used to avoid sticking. The release paper was Kimberly Clark Neenah Avon white classic crest 24 lb. per 1300 sq. ft. with an extruded film of Elvax 3200 (Dupont, Wilmington, Del.), 1.5 mils thick. The Elvax film was corona treated to provide adhesion of the release coat. The release coat was the same as the release coat described above, which was used on the metal plate.

EXAMPLE 2

The grooved film coated backing was coated with a mixture of Michem Prime 4990, 100 dry parts, Titanium dixoide dispersion, 50 dry parts, Tergitol 15 S40 surfactant, 2 dry parts, and XAMA7, 3 dry parts. The coating total solids was approximately 38%. The coating weight was approximately 6 lb. per 1300 sq. ft. Michem Prime 4990 is an ethylene-acid dispersion from Michleman Chemical, Cincinnati, Ohio. The Titanium dioxide dispersion was Ti-Pure Vantage from Dupont, Wilmington, Del. Tergitol 15 S40 is a surfactant from Union Carbide, Danbury, Conn. Michem Prime 4990 is an ethylene-acrylic acid polymer. The pH of the coating was raised to from 9 to 10 with ammonia.

EXAMPLE 3

This was the same as Example 2, except that a print coating was applied over the opaque coating and a multi-colored test print was applied, using a Hewlett Packard 690 ink jet printer. The print coating included 100 dry parts Orgasol 350 EXD, 40 dry parts of Benzoflex 352, 5 dry parts of Triton X100, 4.5 dry parts of Alcostat 167, 3 dry parts of Lupasol SC86X, 2 dry parts of Polyox N60K and 3 dry parts of XAMA7. The total solids content was approximately 25%. The coating was mixed, care being taken to dilute the cationic polymers Lupasol and Alcostat with water and to add them with good mixing to prevent lumping. The pH of the coating was adjusted to between 9 and 10 with ammonia. The entire coating was milled in a colloid mill to dispose the powdered materials. Orgasol 3501 EXD is a powdered polyamide from Atofina, Philadelphia, Pa. Benzoflex 352 is cyclohexane dimethanol dibenzoate from Velsicol Chemical. It was ground to an average size of 8 microns before use. Triton X 100 is a surfactant from Union Carbide, Danbury, Conn. Alcostat 167 is a solution of polydimethyldiallyl ammonium chloride from Allied Colloids, Suffolk, Va. Lupasol SC86X is a solution of an epichlorohydrin treated polyethylenimine from BASF, Mount Olive, N.J. Polyox N60K is a polyethylene oxide from Union Carbide. It was made into a 2% solution before adding. The coating weight of the ink jet print coat was 4.8 lb. per 1300 sq. ft.

EXAMPLE 4

In this example, no opaque, discontinuous coating was applied. The ridged film coated backing was coated only with the print coating of example 3. The coating weight was 5 lb. per 1300 sq. ft. This sample was also printed with a multi-colored test print using a Hewlett Packard 694 printer before the image was peeled and transferred.

The Examples 2 and 3 were both applied to black T-shirt material, while Example 4 was transferred to white T-shirt material. The images were aligned so that the film ridges coating discontinuities were in the same direction as the T-shirt material ribs. In repeated washings up to 5 times, the images of examples 3 and 4, which were very bright after transfer, remained very vibrant. There was no cracking other than in the areas of discontinuity in any of the coatings. After the fabrics were stretched, they rebounded so that the discontinuities were very small and still regularly spaced, rather than looking random or distorted.

EXAMPLE 5

Example 5 was done by making the film coated paper with an engraved chill roll. The roll had a chrome plating and a matte finish.

Engraved patches were put on the roll. Each patch was 12 inches long and 8.5 inches wide. The 12-inch length was in the width direction of the roll and was centered, giving 3 inches on each side with no pattern. The 8.5-inch width of the patches was to be extended around the roll.

Patch #1

Grooves were engraved in both directions, giving a square grid pattern. The grooves were 3 mils wide and 3 mils deep. The spaces between the grooves (land areas) were 30 mils. The edges of the grooves were smooth or rounded with no sharp edges.

Patch #2

Grooves were engraved in only the 12 inch direction, giving a linear pattern. The grooves were 3 mils wide and 3 mils deep. The spaces between the grooves (land areas) were 30 mils.

The paper used in the extrusion coating experiments was 'Supersmooth 24# Avon White Classic Crest', Kimberly Clark grade code 0016V0, from Neenah Paper. The release coating, applied to the side to be coated, was 2.7 lb. per ream of Rhoplex SP100 containing 60 dry parts of Ultrawhite 90 clay per 100 dry parts Rhoplex. Using the engraved chill roll, the paper was coated with Nucrel 599, Elvax 3200 and Surlyn 1702. Surlyn 1702 is a 15-melt index ethylene-methacrylic acid copolymer from Dupont, Wilmington, Del. When 1.8 mils (nominal film thickness, measured in an area having no pattern) of any of these polymers was applied, the films had very little pattern in them.

When the chill roll temperature was raised above 90 degrees F., to imbed the extruded film better into the chill roll patterns, the films adhered too strongly to the chill roll and the paper could not be coated.

When the nominal film thickness in the flat areas was raised to 3 mils, the thickness in some of the patterned areas was approximately 4.5 mils, indicating a raised groove in the film of about 1.5 mils.

Areas of the Surlyn 1702 film coated paper made from patterns 1, 2 and 4 above were coated with an opaque coating and a print coating (OP1 and PC 1 below). The samples were then printed with a multi-colored print pattern using a Hewlett Packard 895 printer. The printed films were then peeled from the paper and transferred print side up to 100% cotton, black T shirt material, using a silicone coated release paper. The transfers exhibited the desired spaces in the opaque and print layers, but the transfers were quite stiff and heavy feeling due to the thickness of the Surlyn film.

The same chill roll was used in a second set of experiments. Release agents were added to Nucrel 599 polymer to reduce sticking to the roll. These were Surfactant 190 from Dow Corning, Midland Mich., a silicone surfactant, tried at 2%, and Micropowders MPP 635, a high density polyethylene wax from Micropowders, Scarsdale, N.Y., at the 10% level, both by weight. Both were successful. The chill roll temperature was raised to 140 degrees F. before the extrusions began to stick to the roll. At 1.8 mils film thickness in the flat areas, the films were approximately 3.8 mils thick in the areas of the patterns.

The OP1 and PC 1 coatings were applied to areas of the paper having patterns from both pattern engraved areas. After printing with the Hewlett Packard 895 printer, the printed films were removed and transferred to the black T-shirt material as described above. When the fabric having the transfers was stretched, it separated only in the areas where the film ridges had been. After stretching, the transfers were softer and more breathable than transfers made with the same castings using a smooth chill roll for the film extrusion step.

It is believed that, while not tested here, a chill roll with grooves of about 5 or 6 mils width and depth would provide even better results; such that the transfers would be soft and breathable without stretching them.

Opaque Coating OP1) This was 100 dry parts of Sancure 2710, 40 dry parts of Rutile Titanium dispersion, 3 dry parts of Triton X 100 and 5 dry parts of XAMA 7. Sancure 2710 is a polyurethane latex form Noveon, Cleveland, Ohio. The coating weight was approximately 6 lb. per 144. sq. yd.

Print Coating PC 1) This was 100 dry parts of Orgasol 3501 EXD NAT 1, 40 dry parts of Benzoflex 352, 5 dry parts of Triton X 100, 6 dry parts of Alcostat 167, 3 dry parts of Polyox N60K and 4 dry parts of XAMA 7. The total solids content was approximately 25%. The Alcostat was diluted to 10% solids and added slowly to prevent lumping. The entire coating was milled in a colloid mil at a setting of about 1 mil. The pH was adjusted to between 10 and 12 with ammonia. The Polyox N60K was added as a 2% solution. The coating weight was 5 lb. per 144 sq. yd.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A heat transfer material comprising:

a substrate layer;

a release coating layer;

a peelable film layer overlying said release coating layer, wherein said peelable film layer is melt-flowable at a transfer temperature; and a discontinuous polymer layer including an opacifying material and a crosslinking agent, said discontinuous polymer layer overlying said peelable film layer.

2. The heat transfer material of claim 1, wherein the opacifying material is a white pigment.

3. The heat transfer material of claim 1, wherein the crosslinking agent is selected from the group consisting of multifunctional isocyanates, epoxy resins, aziridines, oxazolines, and melamine-formaldehyde resins.

4. The heat transfer material of claim 1, wherein the peelable film layer is selected from the group consisting of polyolefins; polyethylene; ethylene-containing copolymers, and mixtures thereof.

5. The heat transfer material of claim 1, wherein the peelable film layer includes an additive selected from the group consisting of a release agent, an ethoxylated alcohol surfactant; a nonionic surfactant; a wax, and mixtures thereof.

6. The heat transfer material of claim 1, wherein the release coating layer is selected from the group consisting of silicone-containing polymers; acrylic polymers; poly(vinyl acetate); polysiloxanes; fluorocarbon polymers; and mixtures thereof.

7. The heat transfer material of claim 1, wherein the release coating layer includes an additive selected from the group consisting of a crosslinking agent; a release-modifying additive; a curing agent; a surfactant; a viscosity-modifying agent; and mixtures thereof.

8. The heat transfer material of claim 1, wherein the substrate layer is selected from the group consisting of cellulosic nonwoven webs and polymeric films.

9. A heat transfer material comprising:

a substrate layer;

a release coating layer;

a peelable film layer overlying said release coating layer, wherein said peelable film layer is melt-flowable at a transfer temperature; and a discontinuous printable layer overlying said peelable film layer, wherein the discontinuous printable layer includes a crosslinking agent.

10. The heat transfer material of claim 9, wherein the peelable film layer is selected from the group consisting of polyolefins; polyethylene; ethylene-containing copolymers, and mixtures thereof.

11. The heat transfer material of claim 9, wherein the peelable film layer includes an additive selected from the group consisting of a release agent, an ethoxylated alcohol surfactant; a nonionic surfactant; a wax, and mixtures thereof.

12. The heat transfer material of claim 9, wherein the release coating layer is selected from the group consisting of silicone-containing polymers; acrylic polymers; poly(vinyl acetate); polysiloxanes; fluorocarbon polymers; and mixtures thereof.

13. The heat transfer material of claim 9, wherein the release coating layer includes an additive selected from the group consisting of a crosslinking agent; a release-modifying additive; a curing agent; a surfactant; a viscosity-modifying agent; and mixtures thereof.

14. The heat transfer material of claim 9, wherein the substrate layer is selected from the group consisting of cellulosic nonwoven webs and polymeric films.

15. The heat transfer material of claim 9, wherein the crosslinking agent is a polyfunctional aziridine crosslinking agent.

* * * * *